US005135331A

United States Patent [19]

Steiner

[11] Patent Number: 5,135,331

[45] Date of Patent: Aug. 4, 1992

[54] COVERING ELEMENT FOR DRAINAGE CHANNELS

[75] Inventor: Alfred Steiner, Andelfingen, Switzerland

[73] Assignee: Waldormills Company Establishment, Vaduz, Liechtenstein

[21] Appl. No.: 650,898

[22] Filed: Feb. 5, 1991

[30] Foreign Application Priority Data

Feb. 5, 1990 [CH] Switzerland ..... 364/90

[51] Int. Cl.[5] ..... E01C 11/22; E01C 5/18

[52] U.S. Cl. ..... 404/2; 404/32

[58] Field of Search ..... 404/2-5, 404/31-32; 210/163, 164

[56] References Cited

U.S. PATENT DOCUMENTS

| | | | |
|---|---|---|---|
| 3,797,188 | 3/1974 | Mansfeld | 404/2 X |
| 4,472,078 | 9/1984 | Karbstein | 404/2 |
| 4,630,962 | 12/1986 | Thomann et al. | 404/2 |
| 4,699,544 | 10/1987 | Karbstein | 404/2 X |
| 4,808,025 | 2/1989 | McGinnis | 404/32 X |
| 4,838,732 | 6/1989 | Clark et al. | 404/2 X |
| 4,909,664 | 3/1990 | Spiess et al. | 404/2 X |

FOREIGN PATENT DOCUMENTS

| | | |
|---|---|---|
| 80901 | 8/1990 | European Pat. Off. . |
| 2506705 | 8/1976 | Fed. Rep. of Germany . |
| 3405628 | 2/1984 | Fed. Rep. of Germany . |

*Primary Examiner*—Ramon S. Britts
*Assistant Examiner*—Nancy Connolly
*Attorney, Agent, or Firm*—Lewis H. Eslinger; Jay H. Maioli

[57] ABSTRACT

A covering element for covering drainage channels on sports fields provides for good surface drainage with a reduction of the danger of accidents for athletes consists of a section plate, made of aluminum, for example, which rests on shoulder surfaces of the drainage channels, and includes side support walls and water drainage slots arranged in the middle. Injury preventing edge elements are mounted with support ribs and the height of support walls and the thickness of edge elements over the support walls are about equal to the height of the upstanding edges of the drainage channels, so that water can consequently flow off well. The edge elements are made of a rubber of Shore hardness A75, so that no danger of injuries to athletes exists, and the edge elements may be colored white for the track side and green or red for the turf side of the sports field.

17 Claims, 2 Drawing Sheets

COVERING ELEMENT FOR DRAINAGE CHANNELS

BACKGROUND OF THE INVENTION

1. Field of the Invention

The present invention relates generally to a covering element for a drainage channel and, more particularly, to a covering element for a drainage channel used in a sports field and having removable colored edge portions and drainage slots.

2. Description of the Background

Covering the edges of a running track or the edge of jumping pit enclosures on sports fields with soft elastic elements to protect the athletes is known according to German Patent Publication DE-U 7030096 or DE-U 7127601. The cover elements are attached for easy removability and are interchangeable. Generally, in such sports fields, drainage passages are recessed for draining the surfaces of rigid pavement sites, such as running tracks. In the case of heavy rainfalls, however, there is a problem that the known edge or sports pit enclosures inhibit drainage.

Drainage channel covers made of plastic are currently already known, but they break easily and can be broken out of the channels by athletes or groundkeeping maintenance machines and thereby lead to injuries.

OBJECTS AND SUMMARY OF THE INVENTION

Accordingly, it is an object of the present invention to provide a drainage channel cover for sports field edges that can eliminate the above-noted defects inherent in the prior art.

In accordance with an aspect of the present invention a soft, elastic, drainage channel cover for a sports field is provided to rest on shoulders of the drainage channel and includes colored edge elements and water drainage openings distributed over the length of the covering plate. The edge elements can be colored to already show the boundaries of the running track, for example. In one embodiment, the soft, elastic edge element is raised above the surface of the drainage channel cover to provide a more obvious boundary.

The above and other objects, features, and advantages of the present invention will become apparent from the following detailed description of illustrative embodiments thereof to be read in conjunction with the accompanying drawings, in which like reference numerals represented the same or similar elements.

BRIEF DESCRIPTION OF THE DRAWINGS

Examples of the prevent invention are illustrated below by means of the drawings, in which.

DETAILED DESCRIPTION OF PREFERRED EMBODIMENTS

Figure 1:
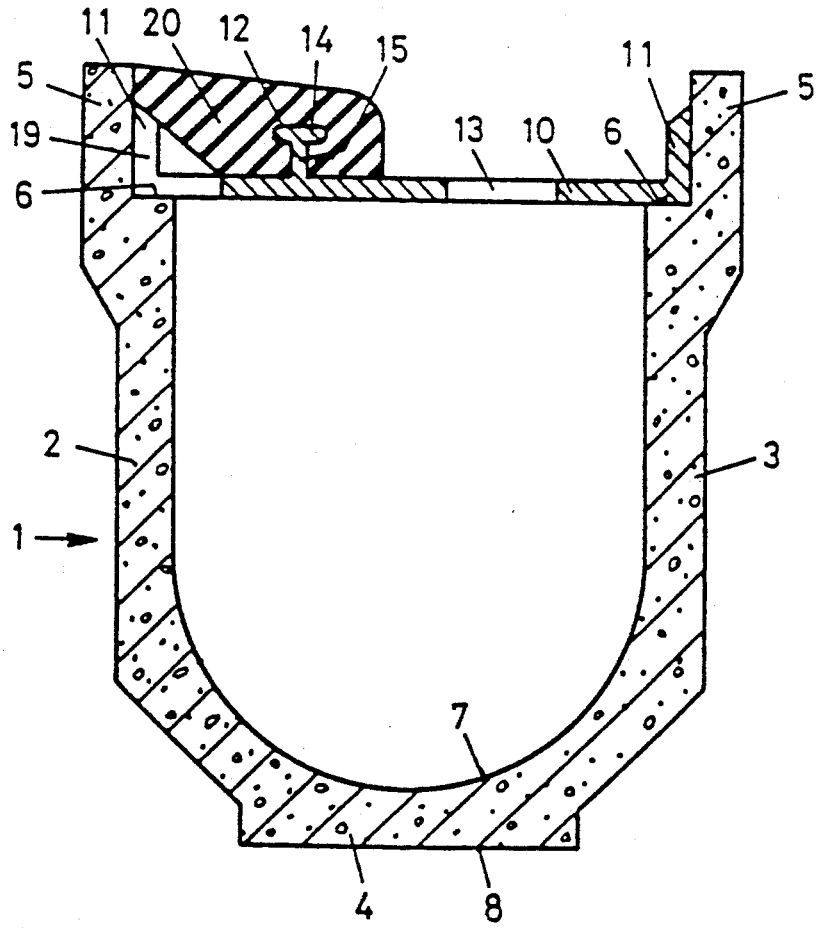
FIG. 1 is a cross-sectional view of an embodiment of a covering in accordance with the present invention installed in a sectional representation of a drainage channel.
Figure 2:
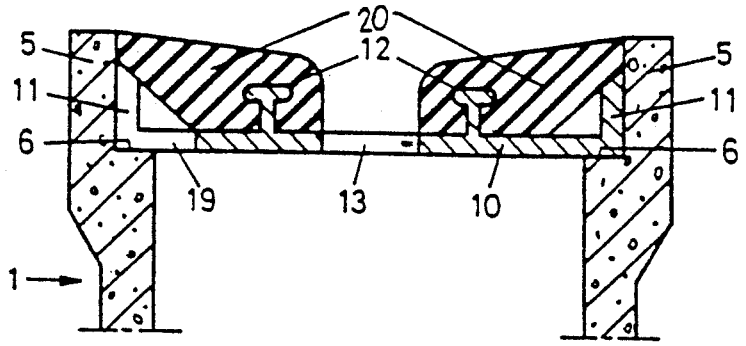
FIG. 2 is a cross-sectional view of a second embodiment of a cover installed in a drainage channel that is only partially represented.

FIG. 1 shows a drainage channel in a generally known form of execution, usually prefabricated in polyester concrete as channel element 1 in units one meter in length. These channel elements 1 consist of a floor wall 4, which is arched or curved on its inside surface 7 and is designed evenly with a flat bottom on its outside surface 8. Side walls 2, 3, which stand essentially vertically relative to outside surface 8, project upwardly on both sides of this floor wall 4. The front sides of side walls 2, 3 each form longitudinally running, upraised edges or ribs 5 on the expanded outside part and horizontal shoulder surfaces 6 directed inwardly connected to these ribs 5.

Section plate 10 according to an embodiment of this invention lies on these shoulder surfaces 6. Section plate 10 has side supporting walls 11, which abut the inside of ribs 5 of drainage channel element 1 and form a protection for ribs 5, but also provide a surface on which a soft elastic edge element 20 rests. Profiled ribs 12 formed with a vertically standing leg 14 and a horizontal support bar 15 serve for supporting this edge element 20 and attaching it to cover plate 10. A corresponding groove 21 is located in edge element 20, so that it is possible to install the soft elastic edge element 20 on support element 12.

As is clearly shown in FIG. 1, the height of support wall 11 plus the thickness of edge element 20 at its outer edge are at least approximately equally as high as the height of rib 5 over shoulder 6 of drainage channel 1.

Section plate 10 has a cutout portion 19 at a selected location along the edge in support wall 11. Cutout portion 19 is also represented by a broken line in FIG. 3. This cutout 19 serves for inserting a rod or the like for removing edge element 20 from section plate 10.

Figure 3:
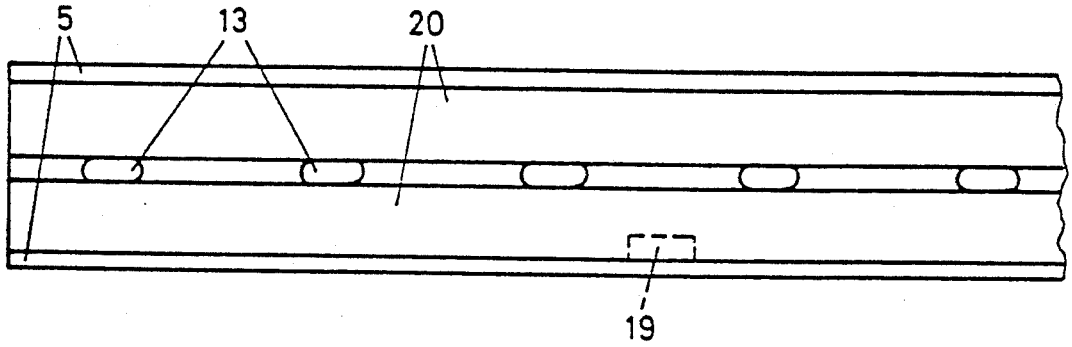
FIG. 3 is a plan view of the embodiment according to FIG. 2.
Figure 5:
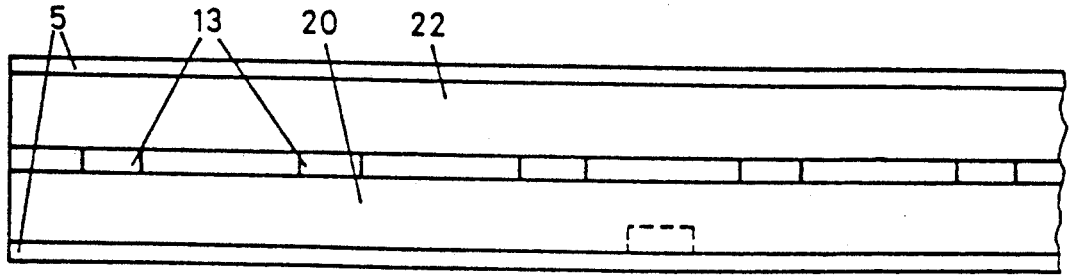
FIG. 5 is a plan view of the form of execution according to FIG. 4.

Furthermore, section plate 10 is provided with water drainage slots 13 along its entire length, as is also shown in plan view in FIGS. 3 and 5.

Section plate 10 is provided with support walls 11 arranged on both sides in FIG. 1. Of course, a support wall 1 could also be provided on only one side, for example as a support for edge element 20 that is provided on only one side of section plate 10.

The soft, protective, edge elements 20 are provided on both sides in another embodiment, both of which are designed identically and each being releasably attached by means of a respective support element 12. Support elements 12 can also be designed with leg 14 and horizontal support bar 15, as described above.

Ribs 5 of drainage channel 1 are shown at both edges of cover plate 10 in the top view of FIG. 3. The support walls 11 of cover plate 10 are covered by the two edge elements 20 and therefore are not visible, however, water drainage slots 13 are distinctly visible.

Because edge elements 20 do not project up over ribs 5 of the drainage channel, water from adjacent surfaces can also flow off quite well, and the drainage channels are able to perform their function even though equipped with the soft protective edge elements 20.

Figure 4:
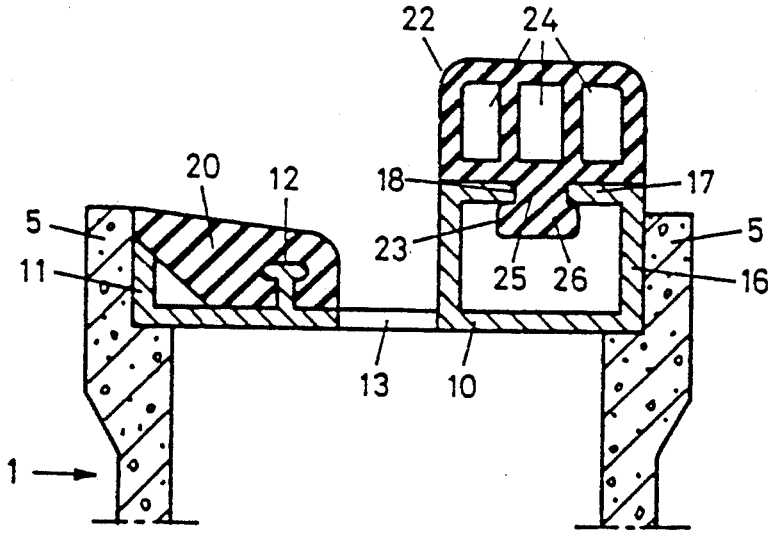
FIG. 4 is a cross-sectional view of a third embodiment of a cover installed in a drainage channel that is only partially represented.

Another embodiment is represented in FIGS. 4 and 5. Section plate 10' includes support wall 11 at the left side in the drawing as was represented in regard to the first embodiment shown in FIG. 1, and is also provided with protective edge element 20, as described above. In this embodiment, section plate 10' includes at the right side in the drawing of FIG. 4 an upraised support section 16, which has a width smaller than half the width of section plate 10'. This support section 16 has the form of a horizontal square prism and includes a longitudinal slot 18 in upper wall 17 opposite section plate 10'.

Protection element 22 is formed with hollow chambers 24 and an attachment rib 23 with leg 25 and horizontal bar 26. Attachment rib 24 fits into slot 23 and serves for attaching protective element 22 to support section 16. An interval is provided between support section 16 and the first protective edge element 20, in which area water drainage slots 13 are again arranged.

It is also possible to provide mushroom-shaped lugs on protection elements 20, 22 instead of the continuous ribs 12 of section plate 10 or attachment ribs 23, so that they look and function like the male parts of snaps in the clothing industry. The edge elements and protection elements described above advantageously consist of rubber on a Shore hardness of A75. According to the type of use, they can be colored green or red for connection on the turf side and white, for example, for the track side of a sports field. The section plate can be an aluminum section, for example, but it is also contemplated to use a stable plastic capable of withstanding stress.

Having described preferred embodiments with reference to the accompanying drawings, it is to be understood that the invention is not limited to those precise embodiments and that various changes and modifications could be effected by one skilled in the art without departing from the spirit or scope of the novel concepts of the invention, as defined in the appended claims.

What is claimed is:

1. Covering element for drainage channels and for marking of intervals in a sports field, which drainage channels are of locally poured concrete or are prefabricated drainage elements and which present two side walls on both sides of a floor wall, the side walls have external longitudinally running ribs on respective upper surfaces, and each having a horizontal shoulder surface directed inwardly of the channels, said covering element characterized by a section plate for resting on the shoulder surfaces of both side walls including at least one support wall projecting outwardly of said section plate on a longitudinal side thereof, and including support elements formed thereon with colored, protective edge elements releasably attached to said support elements, and having water drainage openings distributed over the length of said section plate.

2. A covering element in accordance with claim 1, in which said section plate comprises: two of said support walls along respective longitudinal sides; two of said support elements with said colored, protective edge elements attached hereto; and in which said water drainage openings are arranged at least proximate a center line of said section plate.

3. A covering element in accordance with claim 2, in which a height of said support wall and the thickness of said colored, protective edge element are both at least approximately as high as said external longitudinally running rib of said side walls of the drainage channels.

4. A covering element in accordance with claim 3, in which said support element is a profiled rib with a vertical leg and a horizontal support bar.

5. A covering element in accordance with claim 4, in which said colored, protective, edge element is a rubber element having a groove along its entire length for receiving a support element hooked thereinto in a self-anchoring way, and said edge element has a width smaller than half the width of said section plate.

6. A covering element in accordance with claim 1, in which said section plate has a support wall on one side and further comprises a support section on the other side, said edge element and said support section each have a width less than half the width of the section plate.

7. A covering element in accordance with claim 6, in which said support section has the form of a rectangular hollow prism.

8. A covering element in accordance with claim 7, in which said rectangular hollow prism forming said support section is square and includes a longitudinal groove for attaching said colored protective, edge element on a side surface thereof turned away from said section plate.

9. A covering element in accordance with claim 8, in which the height of said support wall and the thickness of said edge element are each at least approximately as high as the height of the rib of the said walls, and said colored, protective, edge element is formed as an elastic hollow chamber section and includes lugs for attachment to said support section.

10. A covering element in accordance with claim 1, in which a height of said support wall and the thickness of said edge element are both at least approximately as high as one of the ribs of said side walls of the drainage channels.

11. A covering element in accordance with claim 1, in which said support element is a profiled rib with a vertical leg and a horizontal support bar.

12. A covering element in accordance with claim 1, in which said edge element is a rubber element having a groove along its entire length for receiving a support element thereinto hooked in a self-anchoring way, and said edge element has a width less than half the width of said section plate.

13. A covering element in accordance with claim 2, in which support element is a profiled rib with a vertical leg and a horizontal support bar.

14. A covering element in accordance with claim 2, in which said edge element is a rubber element having a groove along its entire length for receiving a support element thereinto hooked in a self-anchoring way, and said edge element has a width less than half the width of said section plate.

15. A covering element in accordance with claim 3, in which said edge element is a rubber element having a groove along its entire length for receiving a support element hooked thereinto in a self-anchoring way, and said edge element has a width less than half the width of the section plate.

16. A covering element in accordance with claim 6, in which the height of said support wall and the thickness of said edge element are each at least approximately as high as the height of the rib of the side walls and said protection element is formed as an elastic hollow chamber section and includes lugs for attachment to said support section.

17. A covering element in accordance with claim 7, in which the height of said support wall and the thickness of said edge element are each at least approximately as high as the height of the ribs of the side walls and said protection element is formed as an elastic hollow chamber section and includes lugs for attachment to said support section.

* * * * *